US005950265A

United States Patent [19]

Allen et al.

[11] Patent Number: 5,950,265

[45] Date of Patent: Sep. 14, 1999

[54] MULTIPLE PURPOSE POCKET TOOL

[75] Inventors: David S. Allen; Richard Joswick, both of New Hartford; Paul Clifford, Cold Brook; Roy A. Gonzalez, Westmoreland; Paul J. Rusyniak, Rome, all of N.Y.

[73] Assignee: Utica Cutlery Company, Utica, N.Y.

[21] Appl. No.: 09/004,468

[22] Filed: Jan. 8, 1998

[51] Int. Cl.[6] ..... B26B 11/00

[52] U.S. Cl. ..... 7/118; 7/138; 30/153

[58] Field of Search ..... 7/118, 138, 158, 7/165, 168; 30/153, 155, 156, 157, 158, 160

[56] References Cited

U.S. PATENT DOCUMENTS

| | | | |
|---|---|---|---|
| 199,868 | 1/1878 | Singleton . | |
| 637,048 | 11/1899 | Toulotte . | |
| 2,503,380 | 4/1950 | Derby | 206/374 |
| 2,798,290 | 7/1957 | Bassett . | |
| 4,570,341 | 2/1986 | Konneker . | |
| 5,400,451 | 3/1995 | Eurukawa . | |
| 5,447,237 | 9/1995 | Carter . | |
| 5,495,674 | 3/1996 | Taylor, Jr. . | |
| 5,647,129 | 7/1997 | Stamper | 30/139 |
| 5,806,119 | 9/1998 | Wood | 7/118 |

*Primary Examiner*—Timothy V. Eley
*Assistant Examiner*—Sinclair Skinner
*Attorney, Agent, or Firm*—George R. McGuire

[57] ABSTRACT

A multiple purpose pocket tool having an elongated housing defining an open cavity, a plurality of elongated ancillary tools pivotally attached to one end of the housing at their proximal ends, and an elongated cover plate pivotally attached to the opposite end of the housing. Each of the ancillary tools includes a slot formed transversely across the top and bottom edges thereof, adjacent their proximal ends. The cover plate includes a downwardly extending flange which engages one of the slots formed in each of the tools when positioned in its terminal closed position, thereby locking the tools in place. The cover plate further includes a protrusion formed on the inwardly facing surface of one of its sidewalls which engages an aperture formed through the corresponding sidewall of the housing when in either its terminal open or closed position, thereby locking the cover plate in such position.

16 Claims, 3 Drawing Sheets

38
36
32
12
22
18
34
28
20
24
24
60
40
70
72
68
42
54
70
72
70
56
54
72
70
44
10
54
70
72
14
46
54
72
70
90
54
48
86
72
82
54
70
96
72
50
76
76
84
70
100
52
54
72
88
62'
62
94
70
66'
98
92
58'
78
74
72
80
16
70
66
62
58
72

MULTIPLE PURPOSE POCKET TOOL

BACKGROUND OF THE INVENTION

The present invention generally relates to multi-purpose pocket tools, and more particularly, to such tools wherein a plurality of tools and blades are mounted for pivotal movement into and out of a housing.

Traditionally, tools such as knives, screwdrivers, files and the like were independently carried in a tool box, thereby making it inconvenient for an individual to carry the tools at all times. In order to provide individuals with a plurality of functional tools that were easily transported, pocket size tools having a variety of elongated tools attached to a single housing in which they may be stored when not in use were developed. Examples of such types of multipurpose pocket tools can be readily seen in U.S. Pat. Nos. 3,875,600 to Reveaux; 758,928 to McGrath; 5,450,774 to Chang; 5,553,340 to Brown, Jr.; 149,806 to Swan; 1,187,842 to Kaas; 2,327,090 to Berg; 97,154 to Barnard et al.; and 5,617,597 to Reitz. Additional multi-purpose tools which collapse down to an easily transportable size have been developed by the Leatherman Tool Group of Portland, Oregon and are exemplified in U.S. Pat. Nos. 4,238,862; 4,744,272; and 4,888,869.

While each of the above listed patents discloses a functional, multi-purpose tool that may be carried by an individual at all times, not all of the referenced apparatus can be safely used. Each of the prior art apparatus include tools that are not securely locked in both their operable and inoperable positions. Therefore, it is possible that an individual using a particular tool on a prior art device will be injured due to the unexpected opening and/or closing of any of the tools comprising the device.

It is therefore a principal object and advantage of the present invention to provide a multi-purpose, pocket tool that includes improved mechanisms for securely locking the ancillary tools pivotally attached to a housing in both their operable (terminal open) and inoperable (terminal closed) positions.

It is an additional object and advantage of the present invention to provide a cover plate pivotally attached to a housing which separates those ancillary tools in their inoperable position from an ancillary tool in its operable position.

Other objects and advantages of the present invention will in part be obvious and in part appear hereinafter.

SUMMARY OF THE INVENTION

In accordance with the foregoing objects and advantages, the present invention provides a multi-purpose pocket tool. The tool generally includes an elongated housing having a plurality of tools pivotally attached to one end thereof, and a cover plate pivotally attached to its opposite end. Each of the tools performs a different function, thereby giving the tool its versatility.

Each of the tools is independently, pivotally movable into and out of the housing with the cover plate being selectively pivotal between terminal open and closed positions, whereby access to the tools positioned within the housing is either permitted or denied, respectively. The cover plate includes a flange extending downwardly from its distal end which, when in its terminally closed position, engages cooperatively positioned notches formed transversely across both the bottom and top edges of each of the ancillary tools, adjacent their proximal ends. Accordingly, the flange will engage one of the two notches formed in each of the tools regardless of whether the tools are in a terminally open or terminally closed position. When using one of the ancillary tools, the secure closure of the cover plate prohibits other tools from accidentally moving out of the housing, and also prevents dust or other debris, produced as a result of a tool's operation, from entering the housing.

An additional safety feature of the present invention is the locking of the cover plate in either its terminally open or closed position. A protrusion is formed on the inwardly facing surface of one of the cover plate's sidewalls, adjacent the proximal end thereof, and a pair of holes having diameters slightly larger than the protrusion are formed through the corresponding sidewall of the housing. The holes are positioned such that one or the other will be engaged by the protrusion when the cover plate is positioned in either of its terminally open or closed positions. In order to reduce the erosion of the protrusion as the cover plate is continually moved between its terminal positions, the positioning of the protrusion is such that it becomes entirely disassociated from the housing when not engaged with one of the holes. Consequently, the only friction realized by the protrusion occurs at the moment when it engages or disengages one of the holes.

In addition to the plurality of different functioning tools and the safety features associated with their operation, the cover plate includes tools incorporated directly into the structure thereof. The planar top surface of the cover plate includes a plurality of different sized hexagonal openings formed therethrough, each one of which may operably engage a correspondingly sized hex-head nut. In addition, the opposing sidewalls of the cover plate include corresponding portions cut away therefrom to form a bottle cap opener. Accordingly, by placing the cover plate in its terminally open position it becomes locked via the protrusion engaging the corresponding hole formed through the housing, and it may be effectively and safely used to loosen or tighten hex-head nuts, or to remove a bottle cap.

BRIEF DESCRIPTION OF THE DRAWINGS

The foregoing and other features of the present invention will be more readily understood and fully appreciated from the following Detailed Description, taken in conjunction with the accompanying drawings, wherein.

DETAILED DESCRIPTION

Figure 1:
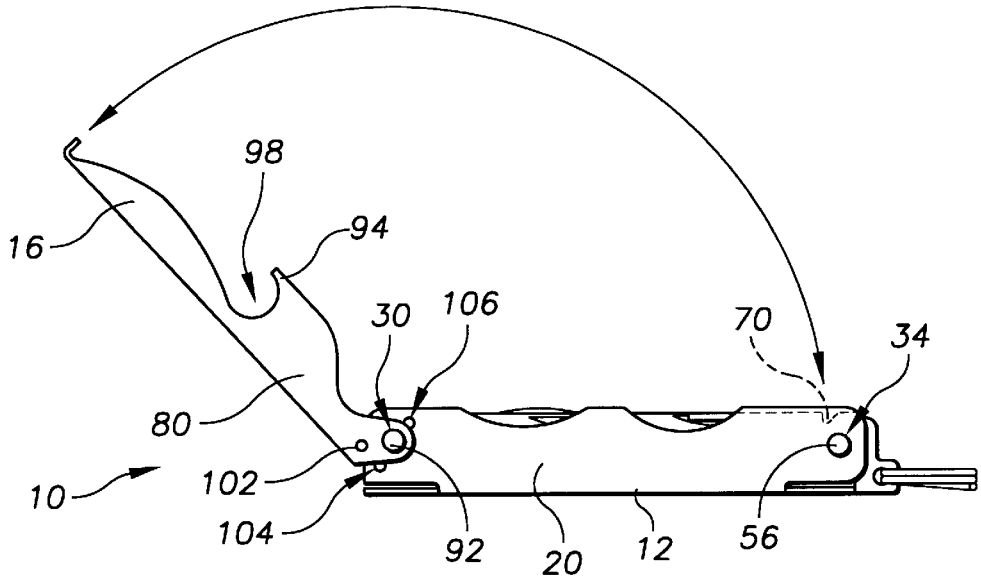
FIG. 1 is a side elevational view of the present invention showing the device with the tools in their terminally closed positions.
Figure 2:
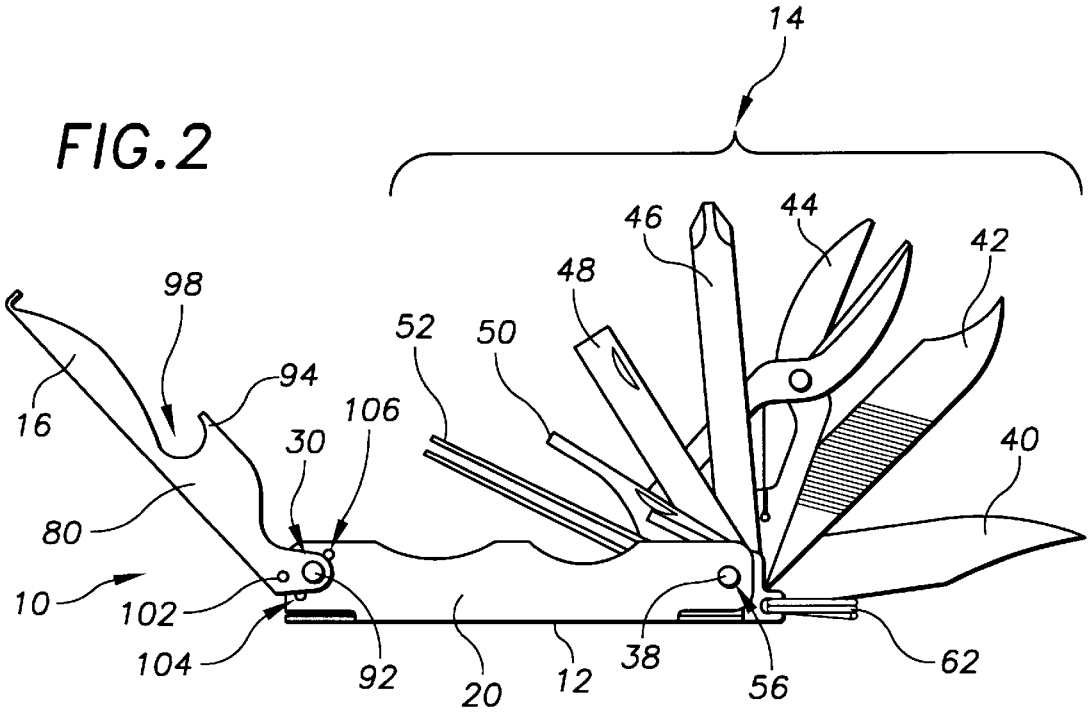
FIG. 2 is a side elevational view of the present invention showing the device with each of the tools in various positions all of which are between their terminally open and closed positions.
Figure 3:
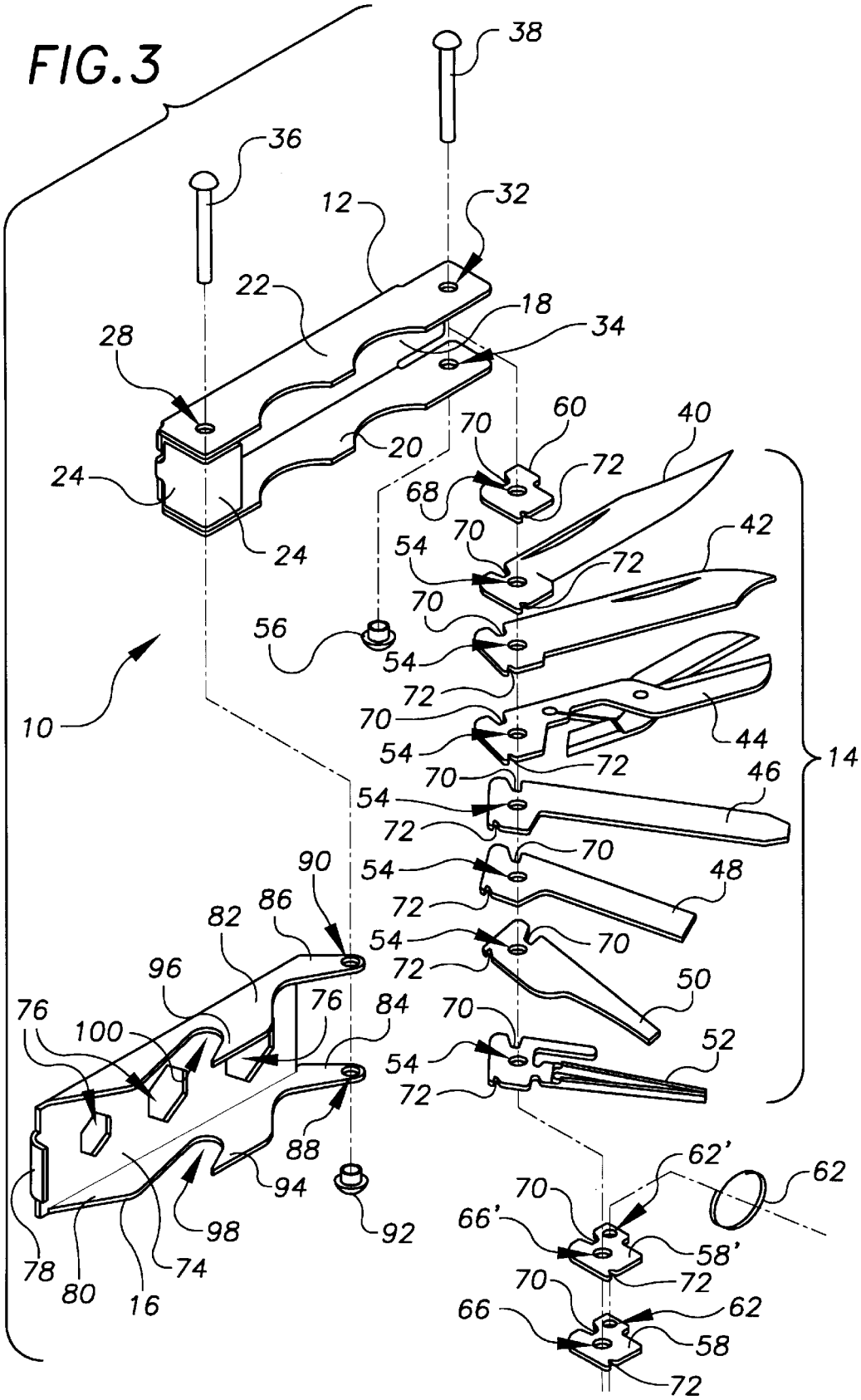
FIG. 3 is an exploded perspective of the present invention.

Referring now to the drawings, wherein like reference numerals refer to like parts throughout, there is seen in FIG.'S 1–7 a multi-purpose device, designated generally by reference numeral 10. Device 10 includes a longitudinal axis X—X and is broadly comprised of an elongated housing 12, a plurality of ancillary tools, collectively and generally designated by reference numeral 14, pivotally attached to the front end of housing 12 for movement between terminal open and closed positions, and an elongated cover plate 16 pivotally attached to the opposite end (the rear-end) of housing 12 for movement between terminal open and closed positions. Each of tools 14 may be independently and selectively moved between its terminal open and closed positions, thereby permitting a user of device 10 to effectively and operably utilize device 10.

Housing 12 includes a planar bottom wall 18, a pair of sidewalls 20 and 22 extending integrally and perpendicularly upwardly from the side edges of bottom plate 18, and a rear wall 24 which extends integrally and perpendicularly upwardly from the rear edge of bottom wall 18. Rear wall 24 includes a hood 26 which extends perpendicularly outwardly therefrom and which lies in a plane that is co-planar to the top edges of sidewalls 20 and 22, and is in spaced, parallel relation to bottom wall 18.

Sidewalls 20 and 22 include holes 28 and 30, respectively, formed therethrough, adjacent the rear end thereof, and holes 32 and 34, respectively, formed therethrough, adjacent the front end thereof. Holes 28 and 30 receive a pivot pin 36 therethrough which serves as the attachment between cover plate 16 and housing 12; and holes 32 and 34 receive a pivot pin 38 therethrough which serves as the attachment between tools 14 and housing 12.

Tools 14 include, in successive order, a knife blade 40, a file 42, a pair of scissors 44, a Phillips head screwdriver 46, a flat-head screwdriver 48, a pick 50, and tweezers 52. Each of tools 14 includes a hole, all of which will be commonly designated by reference numeral 54, formed therethrough, adjacent their proximal ends. Tools 14 are positioned within housing 12 such that pivot pin 38 extends through sidewall holes 32 and 34, as well as each of holes 54. A rivet 56, or other suitable fastener is fixedly secured to the blunt end of pin 38 to ensure that it does not slide out from any of holes 32, 34 or 54.

To ensure that tools 14 positioned adjacent sidewalls 20 and 22, namely, tweezers 52 and knife blade 40, respectively, do not rub against sidewalls 20 and 22 when being moved relative to one another, a pair of spacer members 58 and 60, respectively, are positioned therebetween. Spacer 58 includes an identical spacer 58 fixedly attached thereto in order to double the effective thickness of the space created between sidewall 20 and tweezers 52. This extra space is necessary, in part, to compensate for tweezers 52, which have an effective width greater than the width of spacer 58, and, in part, to provide a secure anchor for a key ring 62 which passes through corresponding holes 64, 64' formed through a portion of spacers 58, 58', respectively, which extend outside the confines of housing 12. Spacers 58, 58' and 60 also each include holes 66, 66' and 68, respectively, formed through portions thereof which are positioned within housing 12, and through which pivot pin 38 extends, thereby securely retaining spacers 58, 58' and 60 to housing 12.

Figure 4:
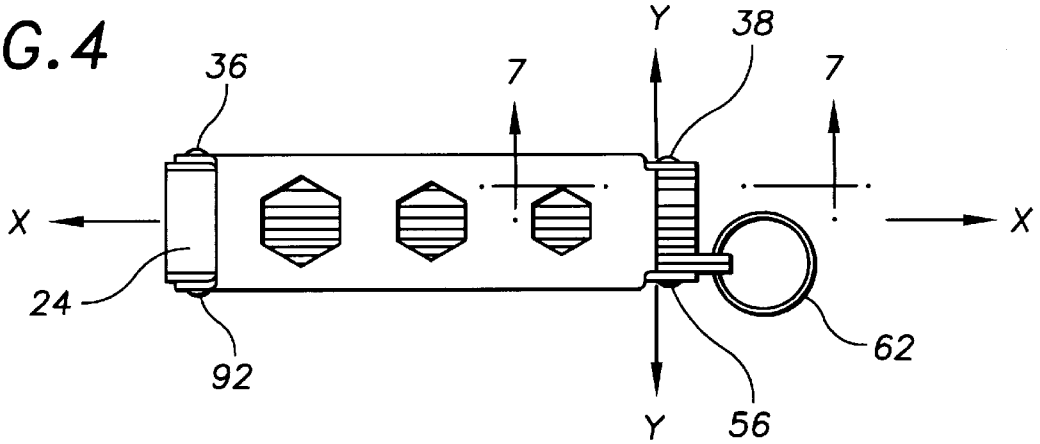
FIG. 4 is a top plan view of the present invention with both the cover plate and tools in their terminally closed positions.
Figure 5:
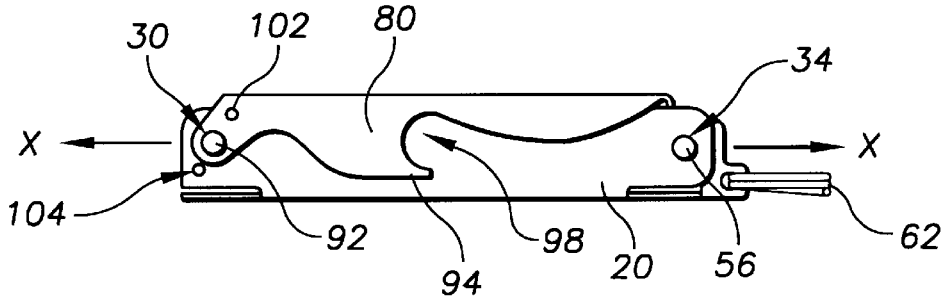
FIG. 5 is a side elevational view of the present invention as it appears in FIG. 4.
Figure 6:
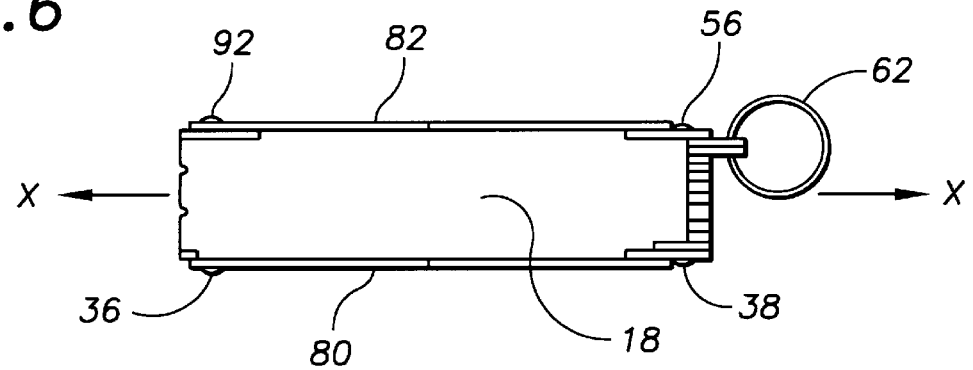
FIG. 6 is a bottom plan view of the present invention as it appears in FIG. 4.
Figure 7:
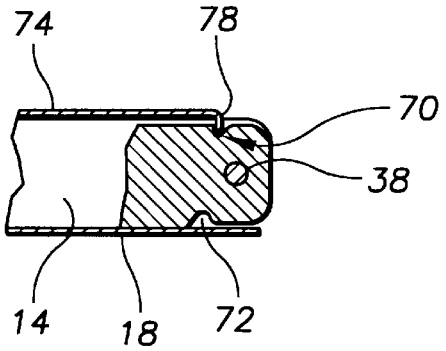
FIG. 7 is a cross-sectional view taken along lines 7—7 of FIG. 4.

Each of tools 14 and spacers 58, 58' and 60 include a pair of slots 70 and 72 formed entirely across the top and bottom edges, respectively, thereof, adjacent their proximal ends. When tools 14 are in their terminal open or closed positions, slots 70 and 72 extend along a common axis Y—Y (see FIG. 4) which extends transverse to axis X—X. Slots 70 and 72 provide, in part, a means for locking tools 14 in either their terminal open or closed positions, as will be further explained hereinafter.

Cover plate 16 includes a planer, top wall 74 having a plurality of differently sized hexagonal openings, commonly designated by reference numeral 76, formed therethrough, a flange 78 extending perpendicularly downwardly from its leading edge, and a pair of sidewalls 80 and 82 extending integrally and perpendicularly downwardly from its side edges. Sidewalls 80 and 82 are separated by a distance slightly greater than the distance separating sidewalls 20 and 22, thereby permitting sidewalls 80 and 82 to be positioned outside of housing 12 when cover plate 16 is in the terminally closed position. Sidewalls 80 and 82 further include ears 84 and 86, respectively, formed adjacent its proximal end. Ears 84 and 86 include holes 88 and 90, respectively, formed therethrough. Cover plate 16 is attached to housing 12 by pivot pin 36 extending through concentrically aligned holes 28, 30 (through sidewalls 20 and 22) and 88, 90 (through sidewalls 80 and 82), and having a rivet 92, or other suitable fastener, fixedly secured to the blunt end of pivot pin 36.

Sidewalls 80 and 82 further include corresponding extension 94 and 96, respectively, which define U-shaped recesses 98 and 100, respectively. Extensions 94 and 96, together with recesses 98 and 100 form a bottle cap opener which may be effectively used to remove a metal cap from a conventional "soda" bottle.

An additional element present on cover plate 16 is the presence of a single protrusion 102 formed on the inwardly facing surface of ear 84, adjacent hole 88. When cover plate 16 is positioned in either its terminal open or closed positions, protrusion 102 will securely engage an aperture 104 or 106, respectively, formed through sidewall 20 of housing 12. By protrusion 102 engaging either aperture 104 or 106, cover plate 16 will be securely locked in either its terminal open or closed position, respectively, thereby diminishing the possibility of cover plate 16 accidentally opening or closing. As cover plate 16 is moved between its terminally open and closed positions, protrusion 102 will become disengaged from aperture 102 and travel in a path disassociated from sidewall 20 before engaging aperture 104 and locking cover plate 16 in its terminally closed position.

In order to ensure that tools 14 do not accidentally move between their terminal open (operable) and terminal closed (inoperable) positions, cover plate 16 should be positioned in its terminal closed position. When in this position, flange 78 will operably engage slot 70 of the terminally open tool 14 and slots 72 of the terminally closed tools 14. In use, therefore, typically only one of tools 14 will be in its terminally open position, while the remainder of tools 14 are in their terminally closed positions, and cover plate 14 will be terminally closed with flange 78 engaging slot 70 and slots 72, thereby locking the tools in their set positions. In order to close the opened tool 14, cover plate 16 can be moved to its terminal open position (with protrusion 102 engaging aperture 104 to lock it in place) and tool 14 may be pivoted to its terminally closed position. Cover plate 16 may then be closed with flange 78 engaging slots 72 and protrusion 102 engaging aperture 106.

Although the invention has been described in connection with the preferred embodiment, those skilled in the act may make changes to certain fixtures without departing from the spirit and scope of the invention as defined in the appended claims.

What is claimed is:

1. A multiple purpose pocket tool, comprising:

a) an elongated housing having a longitudinal axis, first and second opposite ends, first and second sidewalls positioned in spaced, parallel relation to one another and bridged by a planar wall extending perpendicularly there across, and an end wall extending across said first end, said first and second sidewalls, planar wall and end wall together defining an internal cavity, said first sidewall including first and second apertures formed therethrough adjacent to said first end;

b) a plurality of elongated tools each having first proximal and distal ends, top and bottom edges, and firsts and second slots formed transversely across each of said top and bottom edges, respectively, adjacent said first proximal ends, said elongated tools being pivotally attached to said second end of said housing at said first proximal ends for selective, independent movement between terminal open and closed positions; and c) an elongated cover plate pivotally attached to said first end of said housing for selective movement between terminal open and closed positions and having second proximal and distal ends, third and fourth sidewalls positioned in spaced parallel relation to one another and bridged by a second planar wall, said second planar wall including a flange extending downwardly from said second distal end thereof, said flange positioned in engaging relation with either of said first and second slots of each of said elongated tools when said cover plate is in its terminally closed position, said third sidewall including an inwardly facing protrusion formed thereon, adjacent said second proximal end, whereby upon movement of said cover plate into its terminal open position, said protrusion will engage said first aperture formed through said housing's first sidewall, thereby locking said cover plate in its terminal open position, and upon selective movement of said cover plate into its terminal closed position, said protrusion will engage said second aperture, thereby locking said cover plate in its terminal closed position.

2. The tool according to claim 1 and further comprising at least one spacer element positioned immediately adjacent to and between each of said first and second sidewalls and certain of said elongated tools, whereby each of said spacer elements prevents any of said elongated tools from contacting said first and second sidewalls.

3. The tool according to claim 2, wherein said at least one spacer elements are, in part, positioned within said housing and, in part, extend outside of said housing.

4. The tool according to claim 3, wherein said portion of said spacer elements that extends outside of said housing include an aperture formed therethrough.

5. The tool according to claim 4, and further comprising a key ring anchored to at least one of said spacer elements, said key ring passing through said aperture formed through said spacer elements.

6. The tool according to claim 1, and further comprising at least one opening formed through said second planar wall of said cover plate.

7. The tool according to claim 6, wherein said at least one opening is hexagonal in shape.

8. The tool according to claim 6, wherein said at least one opening includes three openings, each of which is of unique, predetermined dimension.

9. The tool according to claim 1, wherein corresponding portions of said third and fourth sidewalls include U-shaped recesses formed therein, whereby said U-shaped recesses function as a bottle cap opener.

10. The tool according to claim 1, wherein at least one of said elongated tools is a knife blade.

11. The tool according to claim 1, wherein at least one of said elongated tools is scissors.

12. The tool according to claim 1, wherein at least one of said elongated tools is a file.

13. The tool according to claim 1, wherein at least one of said elongated tools is a flat head screwdriver.

14. The tool according to claim 1, wherein at least one of said elongated tools is a tweezer.

15. The tool according to claim 1, wherein at least one of said elongated tools is a pick.

16. The tool according to claim 1, wherein at least one of said elongated tool is a Phillips head screwdriver.

* * * * *